US010458053B2

(12) United States Patent
Hulseman et al.

(10) Patent No.: US 10,458,053 B2
(45) Date of Patent: Oct. 29, 2019

(54) MICROSTRUCTURED HIGH FRICTION SURFACE FOR HIGH FRICTION TO FABRIC, YARN, AND FIBERS

(71) Applicant: Hoowaki, LLC, Greenville, SC (US)

(72) Inventors: Ralph Hulseman, Greenville, SC (US); Sarah Hulseman, Greenville, SC (US)

(73) Assignee: Hoowaki, LLC, Greenville, SC (US)

( * ) Notice: Subject to any disclaimer, the term of this patent is extended or adjusted under 35 U.S.C. 154(b) by 0 days.

(21) Appl. No.: 15/827,640

(22) Filed: Nov. 30, 2017

(65) Prior Publication Data

US 2018/0100257 A1 Apr. 12, 2018

Related U.S. Application Data

(60) Continuation of application No. 14/746,296, filed on Jul. 28, 2015, now abandoned, and a continuation-in-part of application No. 14/811,523, filed on Jul. 28, 2015, now Pat. No. 9,908,274, which is a continuation-in-part of application No. 13/404,707, filed on Feb. 24, 2012, now Pat. No. 9,120,670, application No. 15/827,640, which is a continuation-in-part of application No. 14/755,392, filed on Jun. 30, 2015, now abandoned, which is a continuation of application No. 13/404,707, filed on Feb. 24, 2012, now Pat. No. 9,120,670, application No. 15/827,640, which is a continuation-in-part of application No. 14/755,256, filed on Jun. 30, 2015, (Continued)

(51) Int. Cl.
*D05B 27/00* (2006.01)

(52) U.S. Cl.
CPC ..... *D05B 27/00* (2013.01); *D05D 2209/04* (2013.01); *Y10T 428/2438* (2015.01); *Y10T 428/24372* (2015.01); *Y10T 428/24388* (2015.01)

(58) Field of Classification Search
CPC ..... D05B 27/00; D05D 2209/04; Y10T 428/24388; Y10T 428/2438; Y10T 428/24372
See application file for complete search history.

(56) References Cited

U.S. PATENT DOCUMENTS 3,524,373 A 8/1970 Helmus
6,644,156 B2 11/2003 Villacis
(Continued)

OTHER PUBLICATIONS

Sann Nykanen, CAE DS, Drafts, Injection Casting Design.
Freekote, Mold Release Solutions Guide, 2007.

*Primary Examiner* — Brian Handville
(74) *Attorney, Agent, or Firm* — Kim and Lahey Law Firm, LLC; Douglas Kim; Seann Lahey

(57) ABSTRACT

This invention is directed to an improved contact surface for manipulating articles wherein the microstructure included on the contact surface having a plurality of pillars spaced apart in the range of 200 μm and 600 μm, having a height in the range of 50 μm and 1200 μm, a width of in the range of 70 μm and 300 μm, a wall draft angle between 0° and 15°, a density of in the range of 5,000 to 20,000 pillars per square inch, and a friction rating greater than 7. The contact surface can be included on a sewing machine feed dog, a glove, sporting equipment, firearm grip, hand rail, tool grip, tool handle, and a strap such as for a satchel or backpack.

17 Claims, 9 Drawing Sheets

Related U.S. Application Data now abandoned, which is a division of application No. 13/404,707, filed on Feb. 24, 2012, now Pat. No. 9,120,670.

(60) Provisional application No. 62/014,887, filed on Jun. 20, 2014, provisional application No. 61/446,180, filed on Feb. 24, 2011.

(56) References Cited

U.S. PATENT DOCUMENTS

| | | | | |
|---|---|---|---|---|
| 7,735,153 | B1 | 6/2010 | Romiti | |
| 2003/0203155 | A1 | 10/2003 | Kobe | |
| 2010/0319183 | A1* | 12/2010 | Hulseman ..... | B23H 1/06 29/592.1 |

* cited by examiner

MICROSTRUCTURED HIGH FRICTION SURFACE FOR HIGH FRICTION TO FABRIC, YARN, AND FIBERS

CLAIM OF PRIORITY

This Application claims priority from U.S. patent application Ser. No. 14/746,296 filed Jun. 22, 2015, which in turn claims priority on U.S. Provisional Patent Application 62/014,887 filed Jun. 20, 2014. This Application claims priority from U.S. patent application Ser. No. 14/811,523 filed Jul. 28, 2015, which in turn claims priority on U.S. patent application Ser. No. 13/404,707 filed Feb. 24, 2012 which in turn claims priority in U.S. Provisional Patent Application 61/446,180 filed Feb. 24, 2011. This Application claims priority from U.S. patent application Ser. No. 14/755,392 filed Jun. 30, 2015, which in turn claims priority on U.S. patent application Ser. No. 13/404,707 filed Feb. 24, 2012 which in turn claims priority in U.S. Provisional Patent Application 61/446,180 filed Feb. 24, 2011. This Application claims priority from U.S. patent application Ser. No. 14/755,256 filed Jun. 30, 2015, which in turn claims priority on U.S. patent application Ser. No. 13/404,707 filed Feb. 24, 2012 which in turn claims priority in U.S. Provisional Patent Application 61/446,180 filed Feb. 24, 2011.

FIELD OF THE INVENTION

This invention is directed to an improved surface for use on articles such as sewing feed goods, walking dogs, gloves, tools, and other items that can benefit from improving handling and management properties.

BACKGROUND

The clothing, textile and fabric industry have a very early origin. In the manufacturing of materials and products, the manipulation of the fabric is a constant need. The use of sewing needles also has early origins and is a common tool in the manufacturing of clothing and the like from fabrics. The industrial revolution resulted in the mechanization of manufacturing with inventions such as the waterwheel, steam-engine, sewing machines assembly lines and the like.

The loom allows for complex patterns to be obtained. One example is the draw loom which allows a weaving pattern using treadles, or other mechanisms, where the needles are raised and lowered to open the shed in the warp threads. Runners were lifted in turn during the operation of this loom. Automated looms were originally controlled by cards with punched holes where each row in the card represented one row in the ultimate pattern design. Powered looms increased production and originally used steam or water wheels or power generators. In and after the initial manufacturing, there is a need to move and manipulate the fabric without damaging the fabric and with reduced "bunching" or "folding" of the fabric. For example, large sheets of fabric can be cut using cutting tables such as shown in U.S. Pat. No. 6,644,156 where there is a supporting surface mounted on a frame, a cutter, and light emitting devices used to allow for quick alignment of the fabric. The fabric is manually aligned on the table using the light emitting devices. U.S. Pat. No. 3,524,373 also shows a cutting table where the fabric is on a fabric supply roll and fabric is passed downward onto the table for cutting the fabric. The ability to quickly and efficiently manipulate the sheets of fabric is necessary for fabric processing such as cutting. One example of an attempt to improve on the fabric manipulation is U.S. Pat. No. 7,735,153 which discloses glove with grip areas which facilitates the manipulation of sewing implements and fabrics.

Another need of fabric manipulation is during the operating of fabric manufacturing and processing machines such as the sewing machine.

Taking the sewing machine as an example, the majority of sewing machines use a drop feed method that includes use of a mechanism that includes an upper assembly having presser foot and needle that are disposed above the material sewn and the lower assemble which includes a throat plate and feed dogs. When the needle is withdrawn from the material, the feed dogs are pushed upward through slots in the throat plate and moved horizontally past the needle. The presser foot keeps the material in contact with the feed dogs and the horizontal motion causes the material to advance. The feed dogs are then lowered under the throat plate while the needle makes another pass through the material. This prevents the material from travelling while the needle is in the material.

Feed dogs conventionally include metal serrated teeth-like ridges that emerge from the throat plate of a sewing machine. Feed dogs gently grip underneath the fabric, coaxing it to move away from the needle as stitches are sewn. In some configurations, the presser foot includes upper feed dogs to move the upper layer of fabric at the same rate as the lower feed dogs advance the lower layer.

One variation of the drop feed method is when there are two independent sets of feed dogs. The first set is located before the needle and a second set is located after the needle. By changing their relative motions (and therefore the tension on the material), the two sets of feed dogs can cooperate to stretch or compress the material in the vicinity of the needle. This is extremely useful when sewing stretchy material, and when using the over lock stitch, a stitch used for stretchy materials.

While most sewing is done with the feed dogs up, darning and freehand quilting are performed with the feed dogs either down or covered. Putting feed dogs in the down position eliminates the machine's grip on the underside of the fabric, placing the quilter in full control of the movement of fabric. The feed dogs are important to make sure that with the stitching process, the fabric is advanced properly so as not to properly space the stitching and cause the fabric to bunch.

When the feeds dogs do not properly advance the fabric, they quit pulling the fabric through the presser foot area. This problem is magnified with thin or slippery material. Feed dogs that do not properly advance the fabric can cause the operator to wrestle with the fabric rather than have the sewing machine process pull the material through the presser foot with the proper tension. Without the proper tension, a mismatch between the end of the seam can be created with more material leftover on one side than the other. This can be a serious error resulting in undesirable seams when working with such material as nylon or silk and the like. Another problem occurs when the sewing dogs do not advance the fabric, is that slippage occurs and the sewing dog can abrade and damage the fabric.

In some sewing machine models, a walking foot is used in place of the presser foot. A walking foot moves along with lower feed dogs, so that as the walking foot moves, it shifts the upper part of the material (or upper layer of material) with it. This method is typically used when the conventional drop feed method causes the lower layers to shift out of position with the upper layers.

When sewing, the tension of the presser foot or walking foot against the throat plate and lower feed dogs is important and is determined by the thickness and composition of the fabric, the number of layers being sewn and the physical properties of the material (e.g. slipperiness). When the adjustment to the sewing machine is improperly made, the seam created is undesirable resulting in wasted material. Furthermore, when the feeds dogs are worn, the material is not properly advanced which also creates an undesirable seam and waste.

In the sewing process, and other fabric manipulation processes, the operator, whether for the household or for commercial application, must handle material in an efficient manner. In sewing machines, and other machines, the material can be advanced by the machine itself; the material that is in front of and behind the machine has to be fed and managed by the operator to prevent errors. It would be advantageous to have gloves or other assistance to manage and handle such fabric.

Therefore, it is an object of the present invention to provide for a surface that can manipulate an article without damaging or bunching of the article, especially when the article is a fabric.

It is an object of the present invention to provide for a glove that can be used to manipulate fabric material without damaging or bunching of the fabric.

It is an object of the present invention to provide for a contact surface that can be used to manipulate an article to improve gripping and handling properties.

SUMMARY OF THE INVENTION

The above objectives are accomplished by providing a microstructured surface that can be applied to gloves, certain machine surfaces, feed dogs for a sewing machine, handles, grips, and the like. The surface can include a plurality of pillars spaced apart between 200 μm and 600 μm, having a height between 50 μm and 1200 μm, a width between 70 μm and 300 μm, a wall draft angle of between 0° and 15°, a density between 5,000 to 20,000 pillars per square inch, and a friction rating greater than 7. The height can each be greater than 70 μm. The height and width can each be greater than 100 μm.

This surface can be applied to feed dogs of sewing machines and include a first row of pillars arranged in an offset configuration with a second row of pillars. The width can be between 90 μm and 110 μm. The height can be between 90 μm and 110 μm. The pillars can be spaced apart between 325 μm and 375 μm. The pillars can have a square cross-section, circular cross section, trapezoid cross section, polygon cross section or asymmetrical cross section. A rounded, filleted base can be included in each pillar. The feed dog can have a friction force against fabric in a horizontal direction and substantially no friction force in a vertical direction. The microstructures on the contact surface can be manufactured by making a master using lithography, making a rubber sheet from the master, molding a metal molding injection compound from the rubber sheet, sintering the metal injection compound to make a metal mold and make the feed dog from the metal mold. The microstructure on the contact surface can have a plurality of pillars where the pillars have an area between 63 $cm^2/100\ cm^2$ and 242 $cm^2/100\ cm^2$.

The contact surface having the microstructures can be metal, plastic, rubber or silicone. In one embodiment, the microstructures are disposed on a substrate that is attached to the contact surface. The substrate and microstructures can be rigid or semi-rigid. In manufacturing the microstructures, they can be made from a master that can be produced using lithography, EDM, milling, laser or adaptive manufacturing.

DESCRIPTION OF THE DRAWINGS

The invention is better understood by referencing the following figures.

DESCRIPTION OF THE PREFERRED EMBODIMENT

Figure 1:
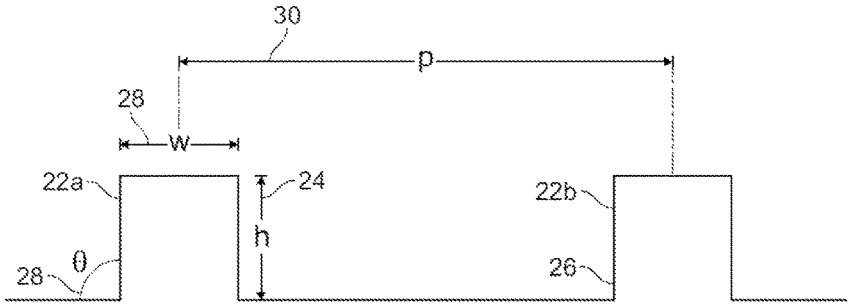
FIG. 1 is an elevated view of aspects of the invention.

Referring to FIG. 1, one embodiment of the present invention is shown by an elevated view of the microstructures that can be attached or otherwise secured to a surface used for manipulating fabrics. The features of the microstructure can include pillars 22*a* and 22*b*. These pillars can have a height (h) shown as 24 that is between 50 μm and 1200 μm. In one embodiment, his between 90 μm and 110 μm. In one embodiment, h is about 100 μm. If the height is too small, the microsurface has unacceptable low friction against fabric. If the pillar height is too large the microstructures become subject to bending and wear life is reduced. In one embodiment, h is greater than 70 μm.

In one embodiment, the pillars can include a coating. The coating can be a lubricating coating. The lubricating coating can be silicone oils, petroleum or mineral oils, PVD-PTFE coating, diamond like carbon coatings, nitride, or carbide coatings.

Each pillar can include a width (w) shown as 28 that is between 70 μm and 300 μm. In one embodiment, w is between 90 μm and 110 μm. In one embodiment, w is between 80 μm to 100 μm. In one embodiment, w is greater than 70 μm. Each pillar can have a diameter of the cross section, if the pillar is circular, between 70 μm and 300 μm. In one embodiment, the diameter is between 90 μm and 110 μm. In one embodiment, the diameter is about 100 μm. The pillars can include a side wall 26 that has a wall draft angle shown as 28 and designated θ. The wall draft angle can be between 0° and 15°. In one embodiment, the wall draft angle is between 1° and 3°. The pillars include a pitch (p) shown as 30, which is the distance between the center points of two pillars. In one embodiment, p is between 200 μm and 600 μm. In one embodiment, p is between 300 μm and 350 μm. In one embodiment the pillars can be perpendicular to the base surface with the central axis forming a 90° angle to the base. In other embodiments, the pillars can be tilted up to 30° from vertical. All of the pillars can be tilted in one direction or different pillars can be tilted in different directions and at different angles.

In one embodiment, p is between 325 μm and 375 μm. In one embodiment, p is about 350 μm. In one embodiment, the pillars can include an area between 63 $cm^2$ and 242 $cm^2$. If the pitch is too small the micro surface has unacceptable low friction against fabric. If the pitch is too large the pillars become subject to bending and wear life is reduced.

In one embodiment, the area of the pillars is between 81 $cm^2$ and 242 $cm^2$. This range is particularly advantageous when the cross section of the pillars is square. In one embodiment, the area of the pillars is between 63 $cm^2$ and 128 $cm^2$. This range is particularly advantageous when the cross section of the pillars is circular.

Figure 2:
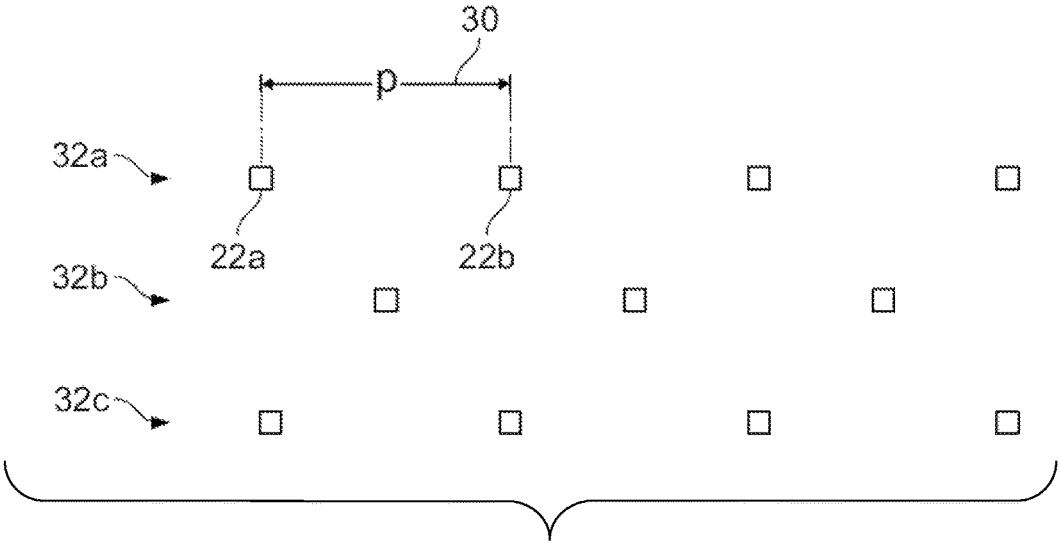
FIG. 2 is a plan view of one row of certain pillars.

Referring to FIG. 2, the pillars can be arranged in rows shown as 32*a* through 32*c*. The row can be offset so that the pillars align vertically in alternating rows 32*a* and 32*c* and pillars of the intermediate row 32*b* are disposed between the pillars of the adjacent rows. The pillars are arranged on a rectangular lattice, a triangular lattice, asymmetrical lattice, repeating lattice pattern or variable distribution of spacing and arrangement.

Figure 3:
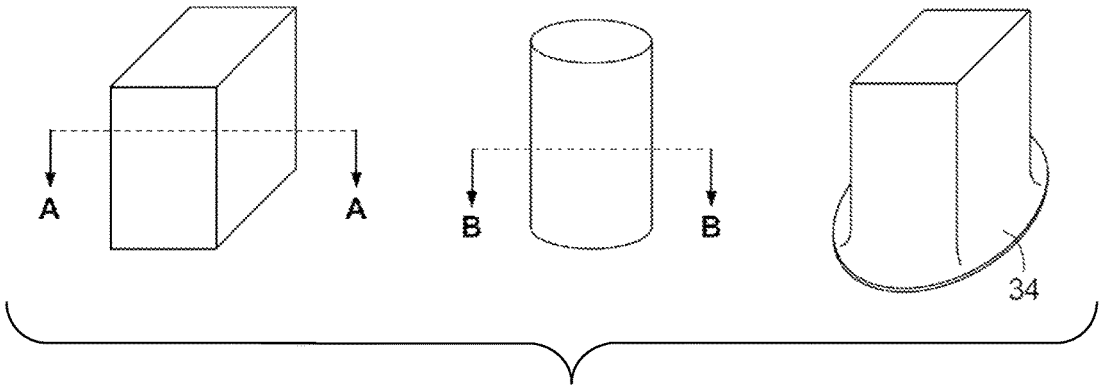
FIG. 3 is a perspective view of aspects of the invention.
Figure 4:
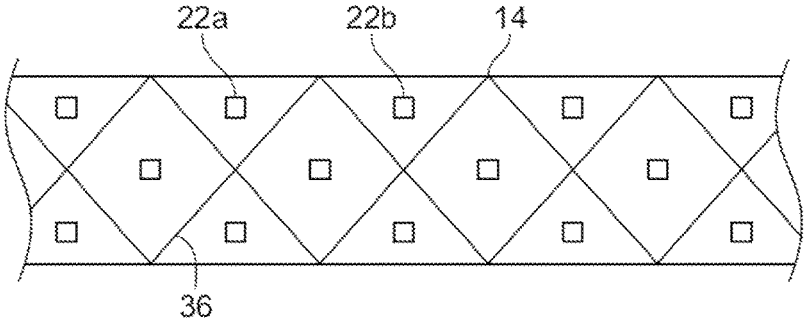
FIG. 4 is a plan view of aspects of the invention.
Figure 5:
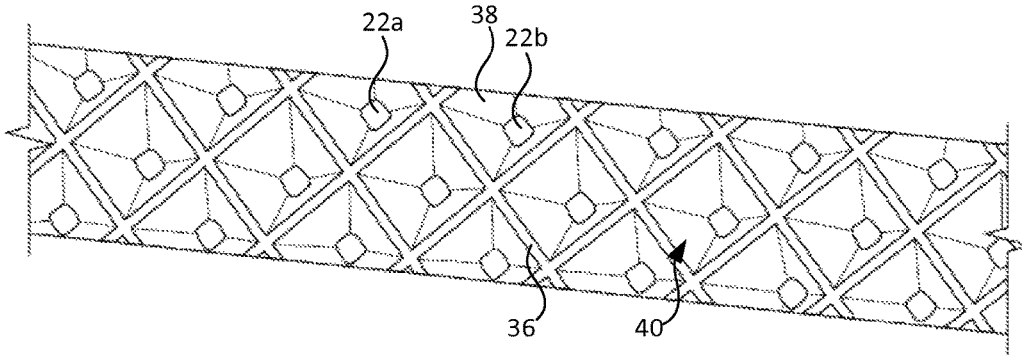
FIG. 5 is a plan view of one aspects of the invention.
Figure 6:
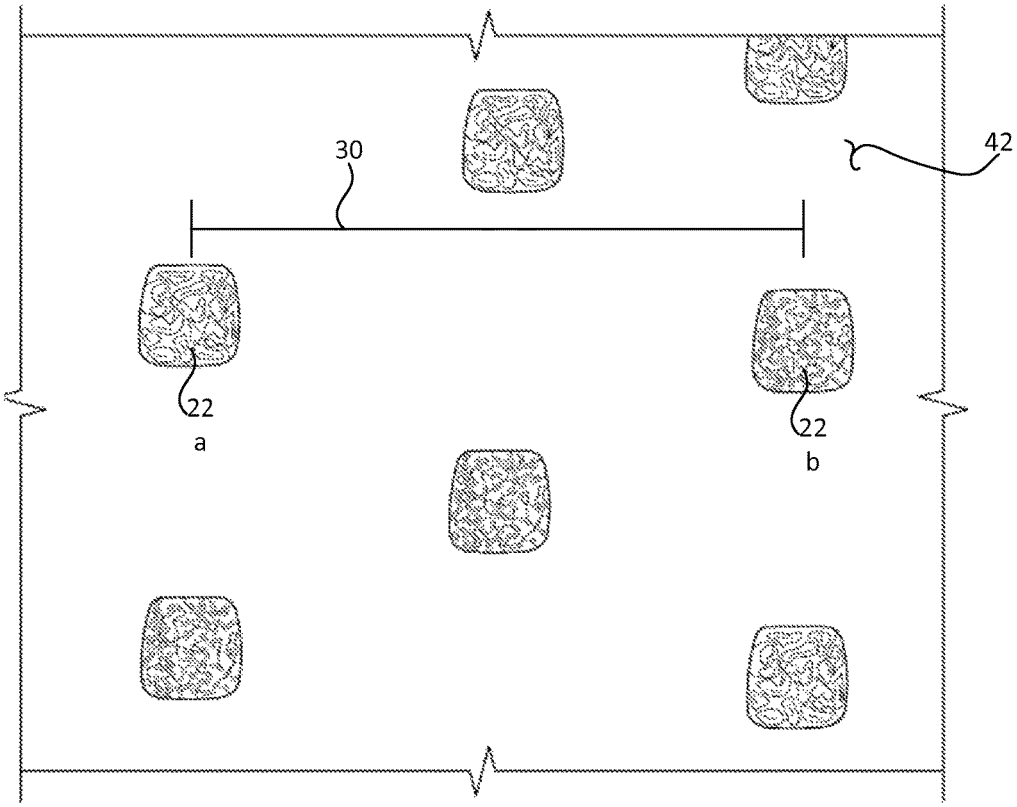
FIG. 6 is a plan view of aspects of the invention.

In one embodiment, the pillars include a cross section along A-A that is square as shown in FIG. 3. In one embodiment, the pillars can include a cross section along B-B that is circular. In one embodiment, the pillars can include a circular base 34. The pillars can be arranged so that they have a density between 2,000 and 20,000 pillars per square inch. Referring to FIG. 4, the pillars are shown in a triangular lattice 36. The microstructure may be made of pillars all of the same width or diameter, pitch and height, or the pillars may have a distribution of width or diameter, pitch and height. Referring to FIG. 5, the triangular lattice configuration can include pillars that are supported by raised structures 38 so that the top of the pillars generally are the same height at the top of the lattice. In one embodiment, the support for the pillars includes a pyramid structure having sides 40. Referring to FIG. 6, the pillars can include the microstructure disposed on the top of the pillars with the substrate or support surface 42 being smooth. The cross section of the pillars in this embodiment is asymmetrical and has a generally trapezoid shape with rounded corners. The offset configuration is shown in this embodiment.

The present invention offers advantages over other material designed to enhance gripping. When the invention is compared to a popular technology "micro-replication" such as used on the gripping products provided by 3M, the following performance results are shown in Tables 2 through 5. In referring to the Fabric, the designations in the left column refer to a microstructures pattern disposed on the material. For example, ABS 002A is a pattern designated as 002A disposed on ABS.

TABLE 2

| Denim Fabric Against: | Feature width | Feature pitch | Feature height | Static Co-Eff | Compared to Smooth ABS | Compared to SafeGuard | Dynamic Co-Eff | Compared to Smooth ABS | Compared to SafeGuard |
|---|---|---|---|---|---|---|---|---|---|
| ABS 000 | 0 | 0 | 0 | 0.82 | 100% | 50% | 0.80 | 100% | 50% |
| ABS 002A | 50 | 100 | 70 | 1.16 | 142% | 72% | 1.10 | 138% | 69% |
| ABS 008A | 200 | 400 | 350 | 1.16 | 142% | 71% | 1.10 | 138% | 69% |
| ABS 009A | 100 | 200 | 200 | 1.76 | 215% | 108% | 1.74 | 219% | 108% |
| ABS 009B | 100 | 200 | 450 | 1.56 | 190% | 96% | 1.30 | 164% | 81% |
| ABS 009C | 100 | 200 | 150 | 1.25 | 153% | 77% | 1.14 | 143% | 71% |
| ABS 021A | 100 | 350 | 400 | 1.70 | 207% | 105% | 1.29 | 163% | 81% |
| ABS 021B | 100 | 350 | 150 | 1.58 | 193% | 97% | 1.67 | 210% | 104% |
| Steel 021B | 80 | 290 | 120 | 2.87 | 350% | 176% | 2.89 | 364% | 180% |
| Santoprene 021B | 100 | 350 | 150 | 2.21 | 269% | 136% | 2.13 | 268% | 133% |
| Hytrel 021B | 100 | 350 | 150 | 1.92 | 234% | 118% | 1.76 | 221% | 110% |
| Greptile/ Tegogrip | 250 | 450 | 420 | 1.79 | 218% | 110% | 1.75 | 220% | 109% |
| SafeGuard | | | | 1.63 | 198% | 100% | 1.60 | 202% | 100% |

TABLE 3

| Stretch Knit Athletic against: | Static Co-Eff | Compared to ABS | Compared to SafeGuard | Dynamic Co-Eff | Compared to ABS | Compared to SafeGuard |
|---|---|---|---|---|---|---|
| ABS 000 | 0.78 | 100% | 34% | 0.74 | 100% | 89% |
| ABS 002A | 1.04 | 133% | 45% | 1.04 | 140% | 334% |
| ABS 008A | 1.31 | 167% | 56% | 2.05 | 277% | 138% |
| ABS 009A | 1.43 | 182% | 61% | 1.85 | 250% | 129% |
| ABS 009B | 1.96 | 250% | 84% | 1.66 | 223% | 202% |
| ABS 009C | 1.34 | 170% | 57% | 1.38 | 187% | 82% |
| ABS 021A | 2.29 | 292% | 98% | 2.60 | 350% | 37% |
| ABS 021B | 3.56 | 454% | 153% | 4.08 | 550% | 51% |
| Steel 021B | 6.86 | 875% | 294% | 9.10 | 1226% | 132% |
| Santoprene 021B | 2.37 | 303% | 102% | 2.78 | 375% | 69% |
| Hytrel 021B | 2.53 | 323% | 108% | 2.67 | 360% | 102% |
| Greptile/ Tegogrip | 1.89 | 241% | 81% | 1.79 | 241% | 92% |
| SafeGuard | 2.33 | 298% | 100% | 2.72 | 367% | 100% |

TABLE 4

| Cotton Shirting Fabric Against: | Static Co-Eff | Compared to ABS 000 | Compared to SafeGuard | Dynamic Co-Eff | Compared to ABS 000 | Compared to SafeGuard |
|---|---|---|---|---|---|---|
| ABS 000 | 0.83 | 100% | 52% | 0.80 | 100% | 47% |
| ABS 002A | 1.24 | 149% | 77% | 1.14 | 143% | 68% |
| ABS 008A | 1.10 | 132% | 68% | 1.10 | 137% | 65% |
| ABS 009A | 1.42 | 171% | 88% | 1.39 | 174% | 82% |
| ABS 009B | 1.51 | 181% | 93% | 1.31 | 164% | 78% |
| ABS 009C | 1.29 | 155% | 80% | 1.13 | 141% | 67% |
| ABS 021A | 1.70 | 205% | 105% | 1.35 | 169% | 80% |
| ABS 021B | 1.57 | 189% | 98% | 1.33 | 166% | 79% |
| Steel 021B | 2.69 | 324% | 167% | 2.60 | 325% | 154% |
| Santoprene 021B | 2.10 | 253% | 131% | 2.02 | 253% | 120% |
| Hytrel 021 | 1.69 | 204% | 105% | 1.37 | 171% | 81% |
| Greptile/ Tegogrip | 1.48 | 178% | 92% | 1.42 | 178% | 84% |
| SafeGuard | 1.61 | 194% | 100% | 1.69 | 212% | 100% |

TABLE 5

| Denim Fabric Against: | Fabric | Static Co-Eff | Compared to Smooth ABS | Compared to SafeGuard | Dynamic Co-eff | Compared to Smooth ABS | Compared to SafeGuard |
|---|---|---|---|---|---|---|---|
| ABS 021B | D | 1.58 | 193% | 97% | 1.67 | 210% | 104% |
| | K | 3.56 | 454% | 153% | 4.08 | 550% | 202% |
| | S | 1.57 | 189% | 98% | 1.33 | 166% | 79% |
| Steel 021B | D | 2.87 | 350% | 176% | 2.89 | 364% | 180% |
| | K | 6.86 | 875% | 294% | 9.10 | 1226% | 450% |
| | S | 2.69 | 324% | 167% | 2.60 | 325% | 154% |
| Santoprene 021B | D | 2.21 | 269% | 136% | 2.13 | 268% | 133% |
| | K | 2.37 | 303% | 102% | 2.78 | 375% | 138% |
| | S | 2.10 | 253% | 131% | 2.02 | 253% | 120% |
| Hytrel 021B | D | 1.92 | 234% | 118% | 1.76 | 221% | 110% |
| | K | 2.53 | 323% | 108% | 2.67 | 360% | 132% |
| | S | 1.69 | 204% | 105% | 1.37 | 171% | 81% |
| Greptile/ Tegogrip | D | 1.79 | 218% | 110% | 1.75 | 220% | 109% |
| | K | 1.89 | 241% | 81% | 1.79 | 241% | 89% |
| | S | 1.48 | 178% | 92% | 1.42 | 178% | 84% |
| SafeGuard | D | 1.63 | 198% | 100% | 1.60 | 202% | 100% |
| | K | 2.33 | 298% | 100% | 2.72 | 367% | 135% |
| | S | 1.61 | 194% | 100% | 1.69 | 212% | 100% |

The above comparisons also includes a walkway safety grip product, SafeGuard, which is a competitor of the product for 3M's Safety-Walk Slip-Resistant General Purpose Tread. Also tested were polymer materials and steel. The friction test is based on ASTM D1894. The Santoprene can have a hardness of 75 (Shore A). This test is a sled type test where the polymer or steel samples were attached to the sled and were all 5 cm×5 cm size. Weight of 200 grams was used on the sled. The fabrics were strapped over a base plate and the sled drags across the fabric. Three fabrics were tested: denim, stretch knit athletic jersey fabric and cotton shirting fabric.

In operation, the microstructures can be manufactured onto the fabric contact surface or subsequently attached to the contact surface. A substrate can have microstructures placed on the substrate on one side and an adhesive placed on the other side to allow the substrate to be secured to a contact surface. The contact surface can be made from material taken from the group consisting of rubber, plastic, brass, bronze, steel, titanium, carbides, or ceramics. The microstructures can be made by any technique used to form plastic, rubber metal, or ceramic such as lithography, molding, NC machining, electrical discharge machining, molten metal casting, powder metal compaction, metal injection molding, or similar techniques well known to those familiar with the art. In one embodiment, the fabrication technique is to make a master pattern by lithography on a silicon wafer; to transfer the pattern to a rubber sheet; to use the rubber sheet to mold metal injection molding compound; to sinter the metal injection compound to make steel, titanium molds, or metal parts. The molds are then used to mold rubber, plastic, ceramic, powdered metal or metal injection compound articles.

Figure 7:
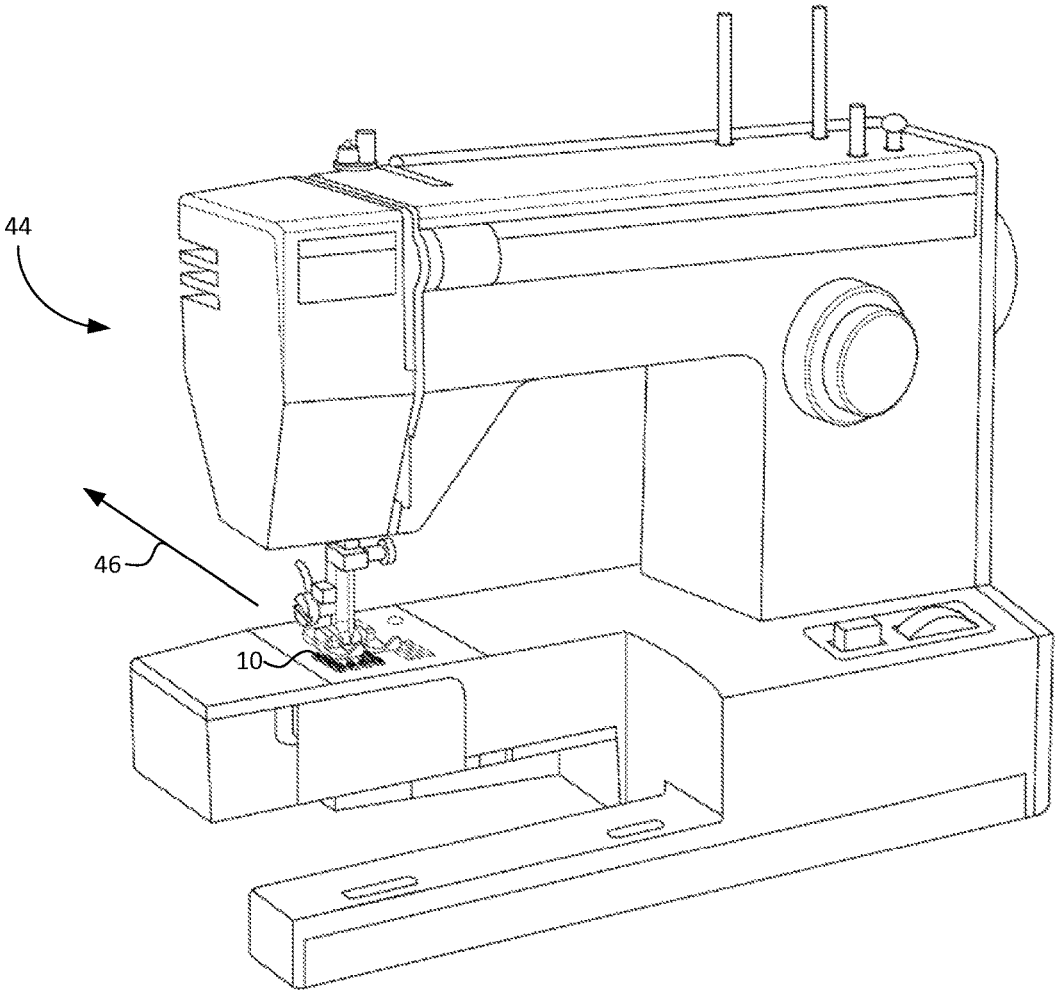
FIG. 7 is a perspective view of aspects of the invention.

In one application, the contact surface is disposed on a feed dog for sewing machine 44 as shown in FIG. 7. The fabric travels generally in a direction shown as 46 and the microstructures on the feed dog grip to move the fabric in direction 46. The microstructures do not grip the fabric when moving in a direction opposite that of 46.

Figure 8:
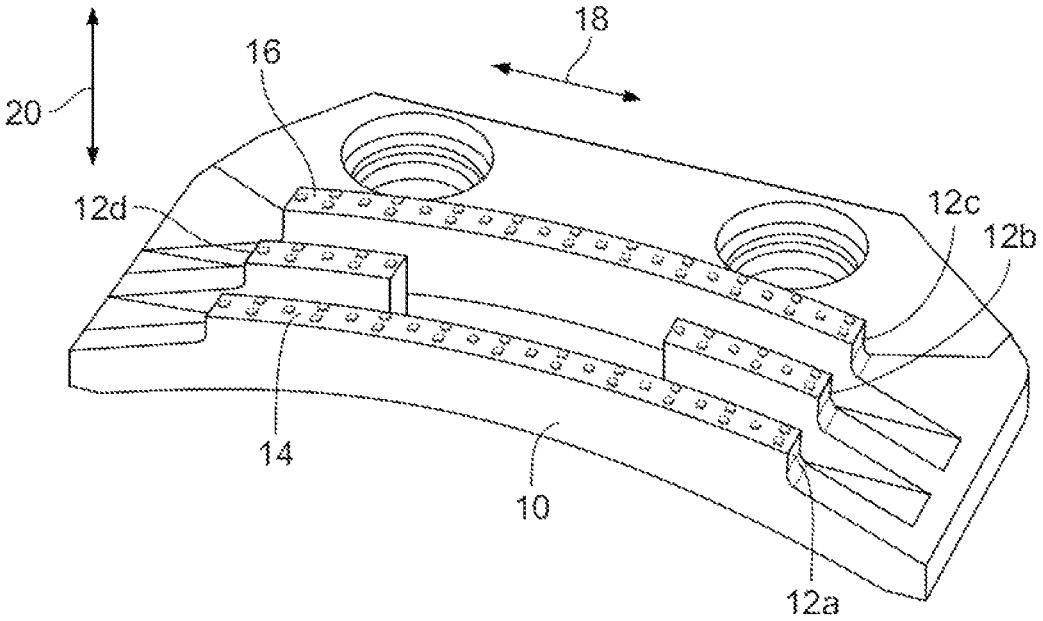
FIG. 8 is a perspective view of aspects of the invention.
Figure 9:
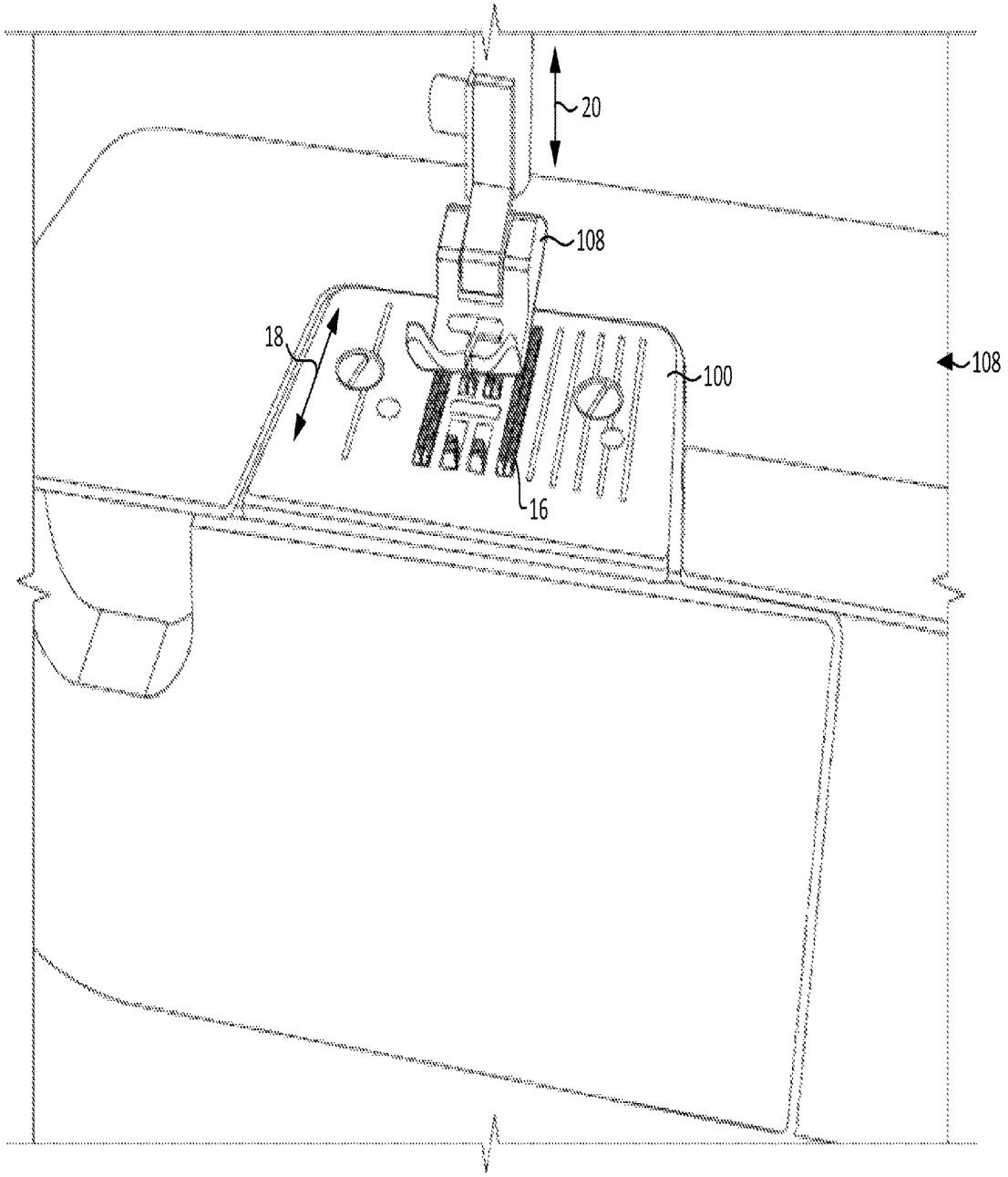
FIG. 9 is a perspective view of the invention installed.

Referring to FIG. 8, a feed dog 10 is shown having risers 12*a* through 12*d* that can protrude through the pressure plate 100 (FIG. 8) of the sewing machine 102. The risers can include a contact surface 14 that includes microstructures 16 and that contacts the fabric to advance the fabric under the presser feet 104 (FIG. 9) and across the pressure plate. The microstructures provide for a friction force to be applied when the contact surface moves horizontally across the fabric in a direction shown as 18 and has substantially no friction force in a vertical direction shown as 20. Feed dogs using the microstructured contact surface have high friction against fabric and allow use of lower pressure on the presser feet of sewing machines. The improved feed dogs achieve higher speed and higher productivity sewing.

Figure 10A:
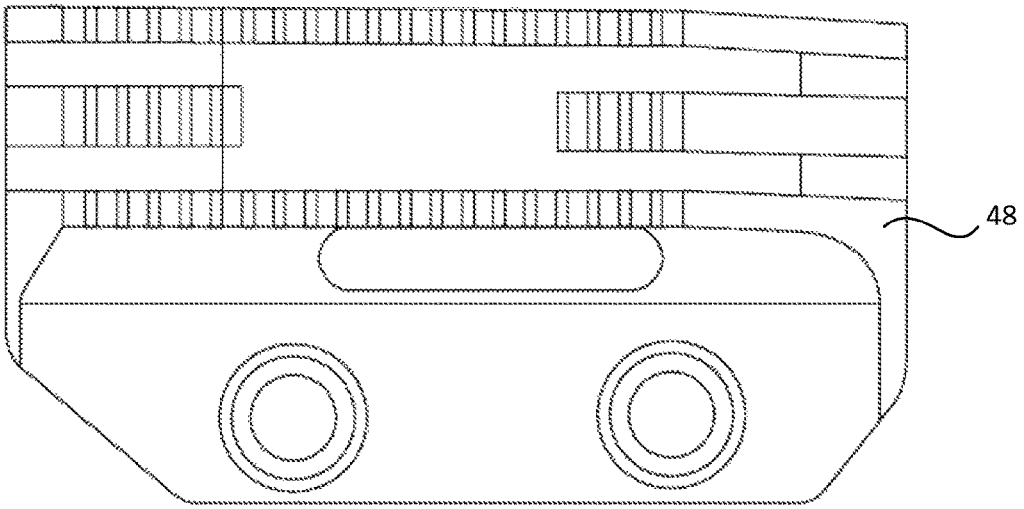
Fig. 10A (Prior Art)
FIG. 10A is a plan view of prior art.
Figure 10B:
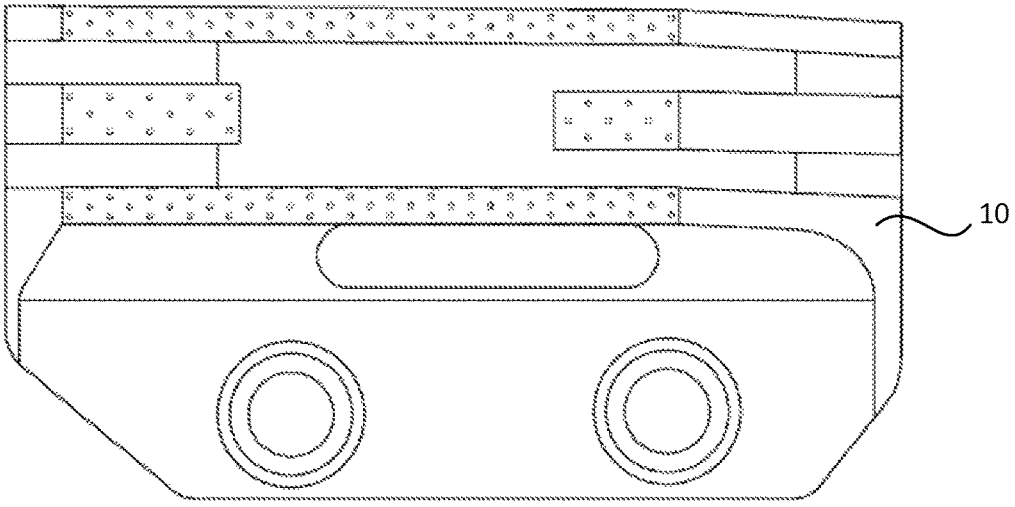
FIG. 10B is a plan view of aspects of the invention.

Referring to FIGS. 10A and 10B, the feed dogs 10 (FIG. 10B) of the current invention can be used to replace conventional sewing feed dogs 48 (FIG. 10A) without modification of the sewing machines. With the invention installed, the fabric is more accurately and consistently fed, life of the feed dog is increased, and consistency of the resulting seam is improved. Feed dogs with the microstructures described herein have high friction against fabric that is uniform in any direction across the fabric surface. Thus the sewing dogs may be used in automated and robotic fabric sewing or handling equipment that must move the fabric in any horizontal direction.

In comparing the microstructure of the present invention to that of the convention feed dogs, the advantages of the present invention are notable. In a friction test designed to measure the tactile response of a user, 2 inch×2 inch squares of molded plastic or formed steel with the microstructures were placed against a fabric by hand and attempted to move laterally. The perceived force of the test subjects was measured on a scale of one to ten and compiled in the following chart.

| Pattern # | Feature width (w) or diameter μm | Feature shape | Pitch (p) μm | Lattice geometry | Feature height (h) μm | Friction rating Cotton shirt (1 to 10) | Friction rating polyester knit (1 to 10) |
|---|---|---|---|---|---|---|---|
| 021A | 100 | square | 350 | triangular | 400 | 10 | 10 |
| 021B | 100 | square | 350 | triangular | 150 | 10 | 10 |
| Smooth steel | | | | | | 1 | 1 |
| Singer commercial feed dog | | | | | | 3 | 3 |

Fabrics that were tested to obtain the above results included paper towels, foam rubber, EVA foam, and Neoprene wet suit material. The microstructures when applied to different contact surfaces would exhibit the same results against the same materials.

Figure 11:
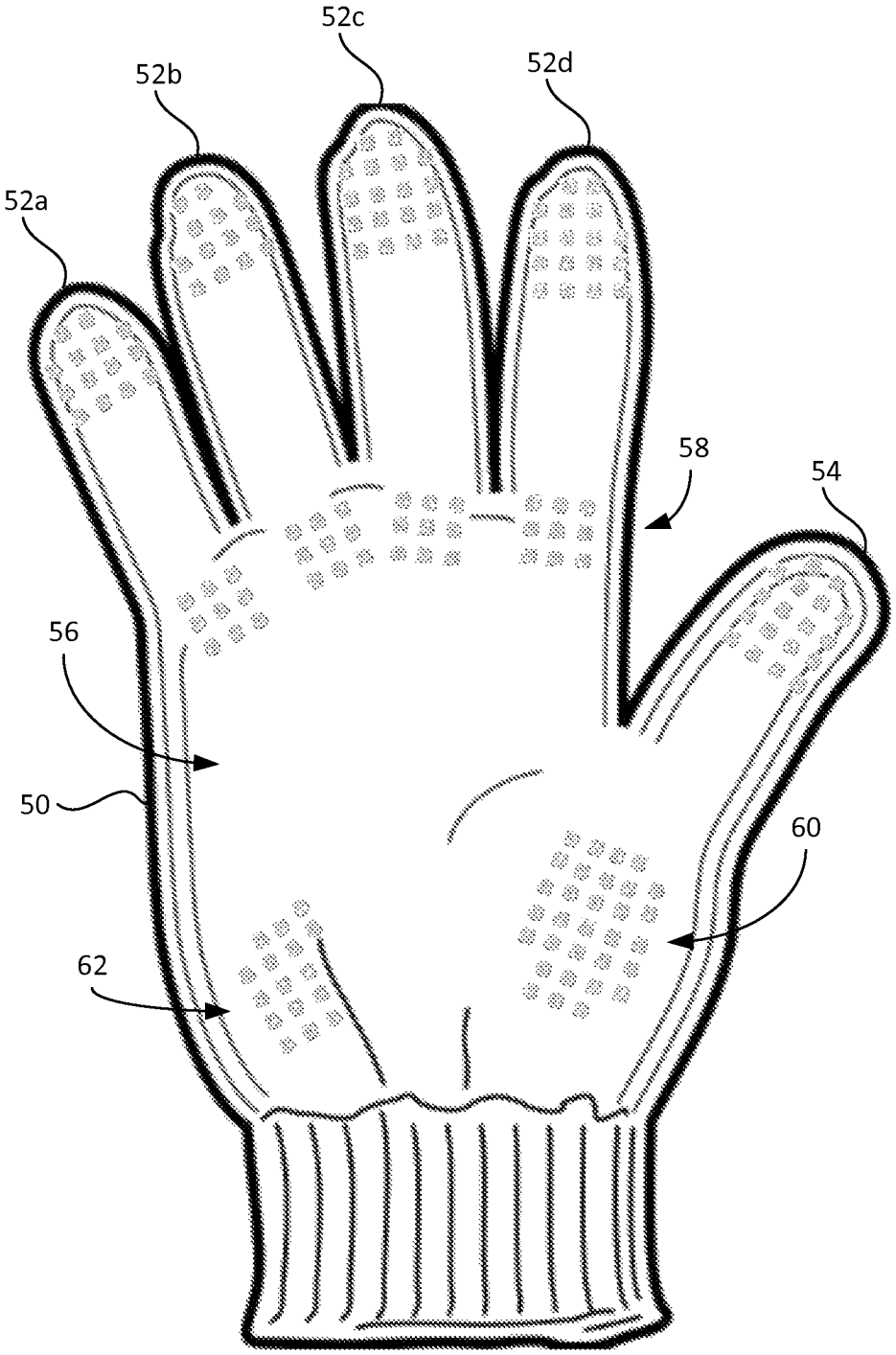
FIG. 11 is an elevated view of aspects of the invention.

Referring to FIG. 11, the contact surface can be a glove 50. There can be several contact surfaces on the glove that can include the fingers, finger tips 52*a* through 52*b*, thumb, thumb pad 54, and palm 56. The palm area can have microstructures attached generally to the entire palm area or portion of the palm area. In one embodiment, the microstructures are attached in a palmar area 58 defined toward the distal end of the hand generally above where the distal palmar crease would be superimposed. The microstructures can be attached in a thenar area 60 defined between the thumb and where the thenar crease would be superimposed. The microstructures can be attached in a hypothenar area 62 defined between the outer edge of the hand and where the thenar crease and proximal palmar crease would be superimposed. The placement of the microstructures can be one generally the entire palm side of the glove or selected portions of the glove.

Figure 12:
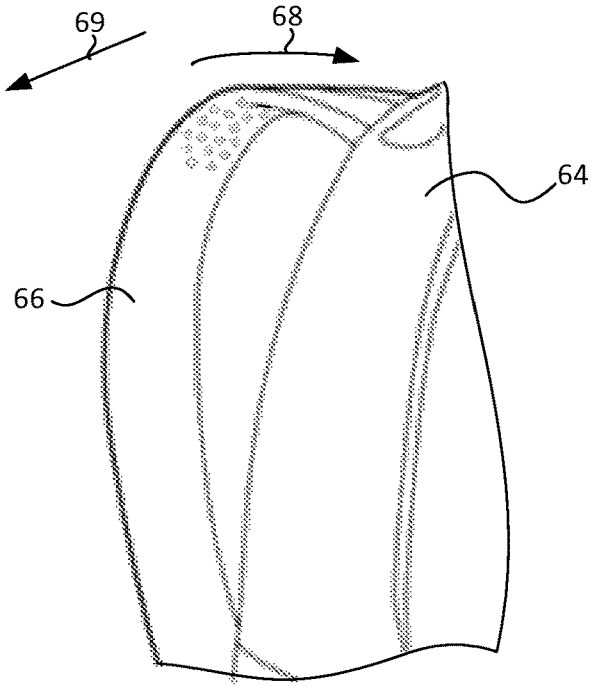
FIG. 12 is a perspective view of aspects of the invention; and,
FIG. 13 is a perspective view of aspects of the invention.

Referring to FIG. 12, the contact surface can also be included in straps for carrying articles such as a briefcase or backpack 64. It is a common complaint that the straps 66 slip off the shoulder with use. The strap typically contacts the shoulder of the wearer and therefore the fabric of the wearer's clothing. The contact surface 68 of the strap can include microstructures that contact the fabric of the wearer's clothing that prevent the strap from slipping in a direction shown generally as 68 or 69. As the microstructures cause a unidirectional grip, the strap can slip onto the shoulder in a direction opposite 68 or 69 for wearing without undue friction impeding proper placement of the straps. The microstructures can be disposed at the top of the underside of the strap and can partially or completely to the lower end of the strap. In one embodiments, the contact surface can be on a medical device, or fitness device that is worn against clothing or that is disposed between the clothing and skin.

Figure 13:
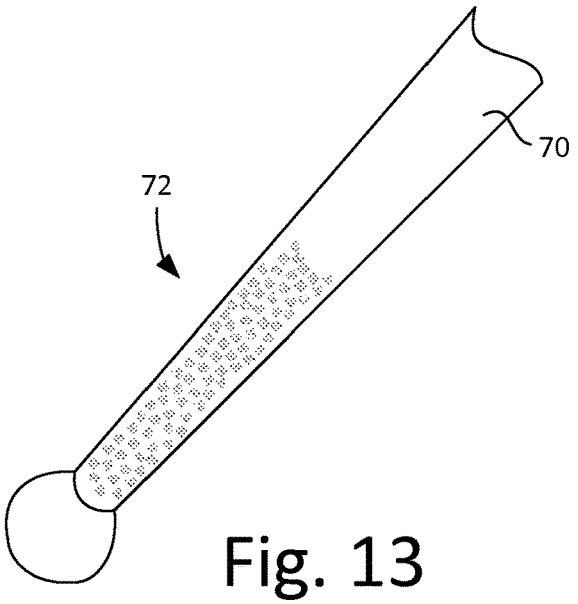

Referring to FIG. 13, the contract surface can be the grip of an article such as a bat 70, cooking utensil, workout weights, sporting goods, tools (including hand tools, power tools, and the like), firearm, hand rail, ladder, handle, roller, tensioning rollers and the like. The rollers can also be used in high speed manufacturing and processing of textiles and fabrics. In one embodiment, the microstructures are disposed on a substrate and the substrate is attached to the article. Concerning rollers, the microstructures can be attached to a sheet that is then wrapped around a roller. The roller is used to feed textiles and fabrics for both the manufacturing process and processing process. For example, when a fabric is exiting a manufacturing machines, the roller tension the fabric so that the fabric is rolled around a core with tension which is advantageous when rolling fabric for storage, transportation and use.

The microstructures can be deposed in an area 72 that is typically gripped with the user wearing fabric gloves. The gloves can be traditional gloves without microstructures such as batting gloves, work gloves, utility gloves, and the like. With the microstructures, the contact between the contact surface and the glove can have increased friction thereby improving the grip even in wet conditions.

In advantage of the present invention is to improve the wearer's experience of articles when the article come is direct contact with the skin. Such articles include breathing masks, watch bands, fitness devices, mouth pieces, shoulder pads, shin guards, and the like. In embodiment of the present invention provides for a pleasant and nice feel and friction against skin, allows circulation and cross circulation of air, allows for evacuating sweat and other fluids, and promoting comfort against the skin.

In one embodiment, the microstructures can be placed on the inner surface of footwear so that there is increased grip between the shoe and a sock. This results in the footwear feeling more secure to the wearer as the shoe does not slip against the sock as much as with a traditional shoe. The microstructure can be placed on a contact surface that is contained to the underside of the tongue.

The advantages of the invention have also shown to be useful for items where the contact surface contacts skin, rather than fabric. Some applications that benefit from this advantage of the present invention include breathing masks, watch bands, fitness devices and other items that come in direct contact with skin. The microstructures contact surface in this embodiment, provides for a pleasant feel, provides for friction against skin, allows circulation and cross circulation of air, allows for the evacuating of sweat and promotes comfort against the skin.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to," or other like phrases in some instances shall not be read to mean that the narrower case is intended or required in instances where such broadening phrases may be absent.

What is claimed is:

1. A contact surface on a first article for manipulating a second article comprising:

a microstructure arrangement included on the contact surface having a plurality of pillars spaced apart between 200 μm and 600 μm, having a height and width in a range of 90 μm and 110 μm and forming a generally square cross section so that said pillars are rigid to resist flexing and bending when contacting an article surface, a wall draft angle between 0° and 15°, a density of between 5,000 to 20,000 pillars per square inch, and a friction rating greater than 7 in relation to the contact surface and an article surface; and, a static co-efficient of friction in the range of 0.78 to 3.56 and a dynamic coefficient of friction in the range of 0.74 to 4.08 as determined by friction test ASTM 1894.

2. The surface of claim 1 including a first row of pillars arranged in an offset configuration with a second row of pillars.

3. The surface of claim 1 wherein the pillars have a pitch in the range of 325 μm and 375 μm.

4. The surface of claim 1 wherein the pillars have a square cross-section.

5. The surface of claim 1 including a circular base included in each pillar.

6. The surface of claim 1 having a friction force against fabric in a horizontal direction and substantially no friction force in a vertical direction.

7. The surface of claim 1 having a non-linear horizontal friction against the article.

8. The surface of claim 1 wherein the pillars are arranged in a triangular lattice.

9. The surface of claim 1 including a lubrication coating on the pillars.

10. The surface of claim 9 wherein the lubrication coating in taken from the group consisting of: silicone oils, petroleum oils, mineral oils, PVD coating, PTFE coatings, diamond-carbon coatings, nitride, and carbide coatings.

11. A surface of claim 1 wherein the pillars have an area in the range of 63 $cm^2$ and 242 $cm^2$.

12. The surface of claim 1 wherein the first article is selected from the group consisting of: a feed dog, a glove, sporting equipment, rollers, tensioning rollers, firearm grip, tool handle, tool grip, and a strap.

13. The surface of claim 12 wherein the microstructure arrangement is attached on a substrate and the substrate is attached to the first article.

14. The surface of claim 12 wherein the strap is a backpack strap.

15. A contact surface on a first article for manipulating a second article comprising:

a substrate disposed on the contact surface of the first article;

a plurality of raised support structures disposed on said substrate, wherein each of said raised support structures has a generally pyramid shape;

a microstructure arrangement included on said substrate having a plurality of pillars having a height in the range of 50 μm and 1200 μm, and a width in the range of 70 μm and 300 μm, wherein said pillars are disposed on top of said support structure;

a wall draft angle in the range of 0° and 15°, a static co-efficient of friction in the range of 0.83 to 1.70 and a dynamic coefficient of friction in the range of 0.80 to 1.39 as determined by friction test ASTM 1894 in relation to cotton fabric.

16. The surface of claim 15 wherein the first article is selected from the group consisting of: a feed dog, a glove, sporting equipment, firearm grip, tool grip, tool handle, and a strap.

17. The surface of claim 15 where the pillars are asymmetrical and have a trapezoid cross section.

* * * * *